US006356723B1

(12) United States Patent
Sato et al.

(10) Patent No.: US 6,356,723 B1
(45) Date of Patent: Mar. 12, 2002

(54) DEVELOPING DEVICE, PROCESS CARTRIDGE AND IMAGE FORMING APPARATUS

(75) Inventors: Fumikazu Sato, Inuyama; Hideaki Deguchi; Naoya Kamimura, both of Nagoya; Mitsuru Horinoe, Aichi-Ken, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/641,919

(22) Filed: Aug. 21, 2000

(30) Foreign Application Priority Data

Aug. 19, 1999 (JP) ..... 11-235573
Aug. 23, 1999 (JP) ..... 11-235571
Sep. 24, 1999 (JP) ..... 11-270040

(51) Int. Cl.[7] ..... G03G 15/08
(52) U.S. Cl. ..... 399/103
(58) Field of Search ..... 399/102, 103, 399/105, 265, 279

(56) References Cited

U.S. PATENT DOCUMENTS 5,488,462 A * 1/1996 Ishikawa et al. ..... 399/103
5,606,397 A 2/1997 Honda et al.
5,634,177 A * 5/1997 Taguchi et al. ..... 399/103
5,663,399 A * 9/1997 Furukawa et al.
5,701,558 A 12/1997 Kojima
5,790,923 A * 8/1998 Oguma et al. ..... 399/105 X
5,794,101 A * 8/1998 Watanabe et al. ..... 399/103
5,870,651 A 2/1999 Shimada
5,983,053 A * 11/1999 Mordenga et al. ..... 399/103
6,070,027 A * 5/2000 Kawai et al. ..... 399/103
6,115,566 A * 9/2000 Ohara et al. ..... 399/103
6,195,515 B1 * 2/2001 Fujita et al. ..... 399/103

FOREIGN PATENT DOCUMENTS

EP 0 585 882 A 3/1994
JP 4-85571 * 3/1992
JP 04-090567 3/1992
JP 05-313473 11/1993
JP 7-295377 * 11/1995
JP 8-76593 * 3/1996

* cited by examiner

*Primary Examiner*—Susan S. Y. Lee
(74) *Attorney, Agent, or Firm*—Oliff & Berridge, PLC

(57) ABSTRACT

In order to prevent toner leaks from both sides of a developing roller disposed within a case accommodating polymerized toner, side seals each having a TEFLON® (polytetrafluoroethylene) felt member on its surface are provided to make sliding contact with a surface of the developing roller. In addition, "Hanarl FL-Z75" (80–90 wt. % hydrofluorocarbon and 10–20 wt. % polytetrafluoroethylene) manufactured by Kanto Kasei Ltd., is used as a lubricating agent for the TEFLON® felt members to make them more lubricative. Accordingly, noise generated by the side seals sliding contact with the developing roller can be reduced. To prevent toner leaks from the sides of the developing roller, a film or resin stopper is disposed at a lower-end front edge of the case to stop the toner.

15 Claims, 21 Drawing Sheets

BONDING REFERENCE LINE ( A )

( B )

ROTATING DIRECTION
OF DEVELOPING ROLLER

DEVELOPING DEVICE, PROCESS CARTRIDGE AND IMAGE FORMING APPARATUS

BACKGROUND OF THE INVENTION

1. Field of Invention

The invention relates to a device that develops an image electrophotographically using a developing agent.

2. Description of Related Art

In a well-known developing device, an electrostatic latent image formed on the surface of a photosensitive drum is developed by electrostatically depositing toner carried on the surface of a developing roller onto the latent image. Toner leaks in the developing device frequently cause problems. Leaking toner may contaminate the inside of an image forming apparatus and result in poor printing, or may stain an operator's hands or clothes.

Particularly, when a non-magnetic one-component toner is used, toner is held on the surface of the developing roller mainly by intermolecular forces and may leak when the developing roller receives even a slight impact or is inclined.

To prevent such toner leaks, toner leak prevention members are provided inside the developing device. Particularly, to prevent toner leaks from both ends of the developing roller, toner leak prevention members called side seals are provided so as to make sliding contact with a circumferential surface of the developing roller at its both ends.

The side seals are formed by bonding a sliding contact member made of TEFLON® felt to a urethane spongy material. The urethane spongy material is required to be sufficiently soft and less likely to deform permanently due to compression. The sliding contact member is used to provide adequate pressing force and reduce rotation torque. However, when such side seals are used, a problem arises in that the side seals generate noise when they make sliding contact with the developing roller.

SUMMARY OF THE INVENTION

The invention intends to reliably prevent not only noise generated during sliding contact between the developing roller and the side seals but also toner leaks.

In a developing device according to the invention, a sliding contact surface of each developing agent prevention member makes sliding contact with a developing agent carrier at its either end. Accordingly, the developing agent is prevented from leaking from the sliding contact portions. In addition, as a lubricating agent is applied to the sliding contact surfaces, noise is prevented from generating when the sliding contact surfaces contact the developing roller.

The developing agent prevention members are made of a fluorine-based resin in fiber form. Accordingly, the lubricating agent efficiently enters the fibers of the developing agent prevention members and improves their noise preventing effect and developing agent leak preventing effect.

Further, when the direction of fibers on the sliding contact surfaces are previously aligned with the rotation direction of the developing agent carrier, the developing agent moving perpendicularly to the rotation direction is more reliably prevented from entering the sliding contact surfaces.

At least a fluorine-based resin such as polytetrafluoroethylene (PTFE), is preferably contained in the lubricating agent applied to the sliding contact surfaces. A fluorine oil is more preferably contained in the lubricating agent. In an embodiment of the invention, "Hanarl FL-Z75" (80–90 wt. % hydrofluorocarbon and 10–20 wt. % polytetrafluoroethylene), made by Kanto Kasai Ltd., is used as the lubricating agent. By use of the lubricating agent, the developing agent carrier and the sliding contact surfaces can be kept highly lubricated. Accordingly, noise generated from the developing agent carrier and the sliding contact surfaces can be dramatically reduced. At the same time, toner leaks from the both ends of the developing agent carrier can be prevented to the extent there is no serious problem, i.e., there is minimal transfer of leaked toner onto the printed medium.

Further, a developing agent stopper may be provided at a lower-end front edge of a developing agent container to stop the developing agent on a bottom surface of the container. In case the developing agent leaks from any developing agent leak prevention member, the leaking developing agent can be stopped by the developing agent stopper, causing no contamination with the developing agent of an operator's hands or the inside of the image forming apparatus.

The developing agent stopper is formed by a film member affixed to the lower-end front edge of the container or a resin member assembled to the container. Accordingly, the developing agent stopper is very easy to mount, yet can effectively stop the developing agent.

When the developing agent stopper is formed integrally with the container, it requires no assembling work and will improve assembling efficiency of the developing device.

A process cartridge provided with the above-described developing device tends to receive impacts when it is detached/attached. In such a case, no developing agent leaks from the periphery of the developing agent carrier, causing no contamination with the developing agent of the inside of the process cartridge, the inside of the image forming apparatus, or the surface where the image forming apparatus is installed.

Further, the developing device may be structured to be a detachable developing device cartridge and may be mounted in the process cartridge. In this case, similarly to the above case, no contamination with the developing agent is caused.

Recent-model image forming apparatuses often use polymerized toner as the developing agent. The polymerized toner has a very small particle size and is suitable for forming fine images. On the other hand, the polymerized toner has a high flowability and is likely to leak from the developing device. When the polymerized toner is used in the developing device in accordance with the invention, toner leaks from the ends of the developing agent carrier, which are the most leak-prone, are reliably prevented, causing no contamination of the surroundings with the toner.

BRIEF DESCRIPTION OF THE DRAWINGS

A preferred embodiment of the invention will be described in detail with reference to the following figures wherein.

DETAILED DESCRIPTION OF PREFERRED EMBODIMENTS

A preferred embodiment of the invention will now be described with reference to the attached figures.

Figure 1:
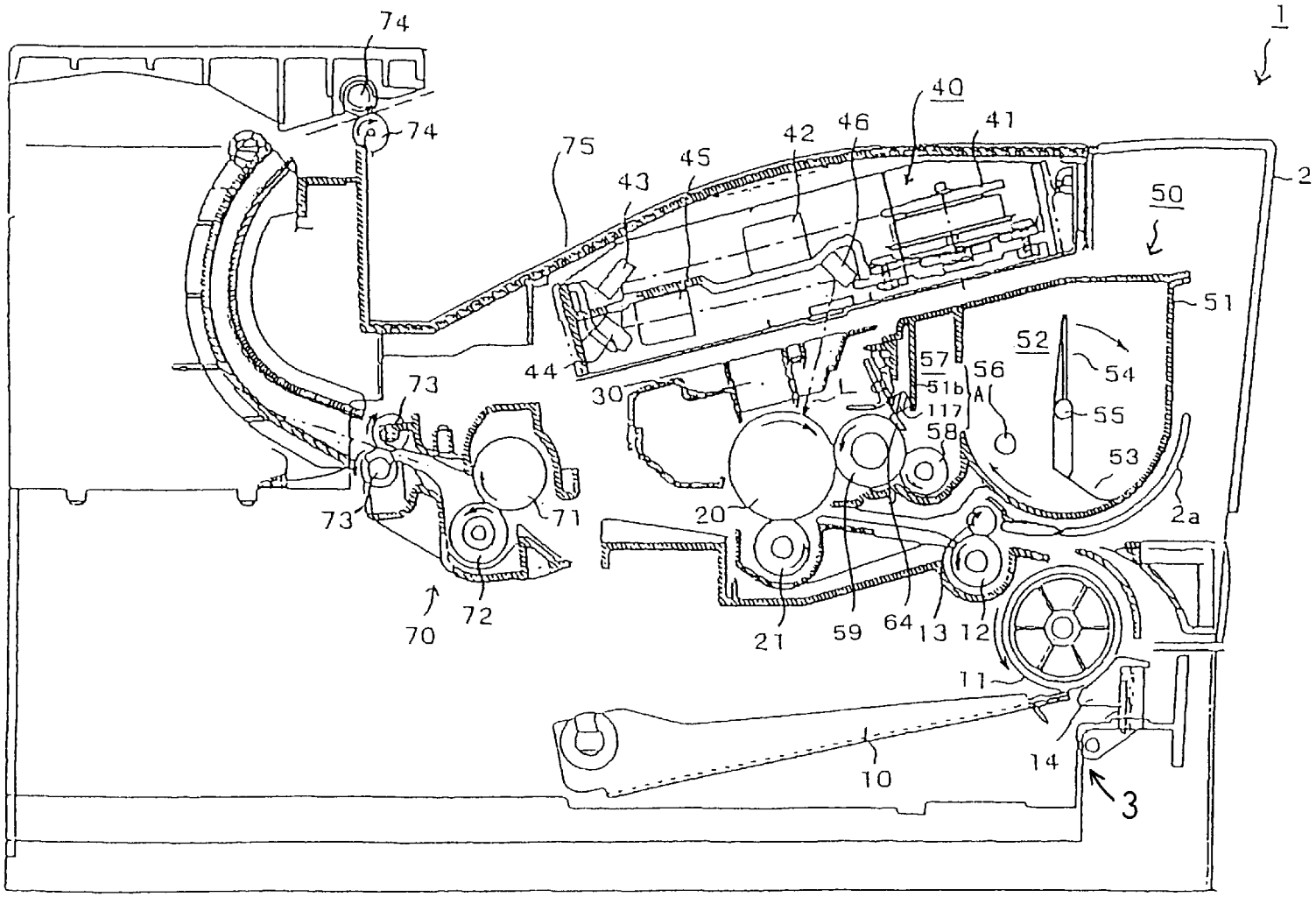
FIG. 1 is a schematic sectional view showing the structure of a laser beam printer.

FIG. 1 is a schematic sectional view showing the structure of a laser beam printer 1. As shown in FIG. 1, the laser bean printer 1 has, at the bottom of a body case 2, a feeder unit 3 that feeds sheets of paper (not shown). The feeder unit 3 includes a sheet pressing plate 10 that is urged upward by a spring (not shown), a sheet feed roller 11, and a frictionally separating member 14. When the sheet feed roller rotates while the sheet pressing plate 10 presses sheets of paper against the sheet feed roller 11, only the uppermost sheet is separated. Then, the separated sheet is fed between the sheet feed roller 11 and the frictionally separating member 14 at predetermined timing.

A pair of resist rollers 12, 13 are rotatably supported along the sheet feed direction and downstream of the sheet feed roller 11, which rotates in the direction of an arrow shown in FIG. 1 and conveys, at predetermined timing, a sheet of paper to a transfer position defined by a photosensitive drum 20 and a transfer roller 21.

The photosensitive drum 20 is formed by an organic photosensitive body mainly composed of positively charged polycarbonate. More specifically, the photosensitive drum 20 is formed by an aluminum cylindrical sleeve, and a hollow drum formed around the aluminum cylindrical sleeve. The hollow drum has an approximately 20 $\mu$m-thick photoconductive layer made of photoconductive resin-dispersed polycarbonate. The photosensitive drum 20 is rotatably supported by the body case 2, while the cylindrical sleeve is grounded. In addition, the photosensitive drum 20 is rotationally driven in the direction of an arrow by driving means (not shown).

A charger 30 is a scorotron charger that generates corona discharge from a tungsten charging wire.

A laser scanning unit 40 includes a laser generator (not shown) that generates laser light L with which an electrostatic latent image is formed on the photosensitive drum 20, a polygon mirror 41 that is rotationally driven, a pair of lenses 42, 45, and reflection mirrors 43, 44, 46.

In a developing device 50, a toner chamber 52 is formed in a case 51. In the toner chamber 52, an agitator 53 and a cleaning member 54 are mounted such that they can rotate about a rotation shaft 55. The toner chamber 52 accommodates electrically insulative, positively charged non-magnetic one-component toner. Light-transmitting windows 56 are provided on sidewalls of the toner chamber at both ends of the rotation shaft 55. A developing chamber 57, which communicates with the toner chamber 52 via an opening A is formed on the photosensitive drum 20 side of the toner chamber 52. A supply roller 58 and a developing roller 59 are supported rotatably in the developing chamber 57. Toner on the developing roller 59 is regulated to a predetermined thickness by an elastic, thin plate-shaped layer thickness-regulating blade 64.

The developing roller 59, that functions as a developing agent carrier, is formed by providing a cylindrical base material made of a conductive silicone rubber, which contains conductive carbon fine particles, around a stainless steel core metal. In addition, the base material is coated with a layer of fluorine-containing resin or rubber. The base material of the developing roller 59 is not necessarily made of a conductive silicone rubber, and it may be made of a conductive urethane rubber.

Figure 9A:
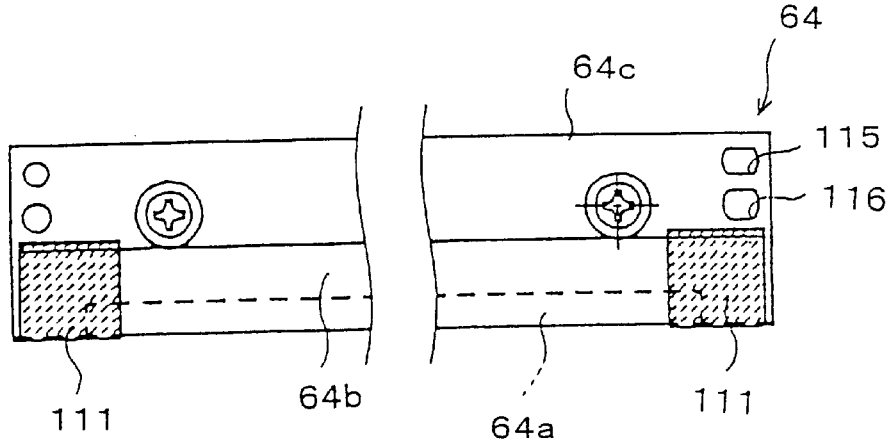
FIG. 9A is a rear view of a layer thickness-regulating blade.
Figure 9B:
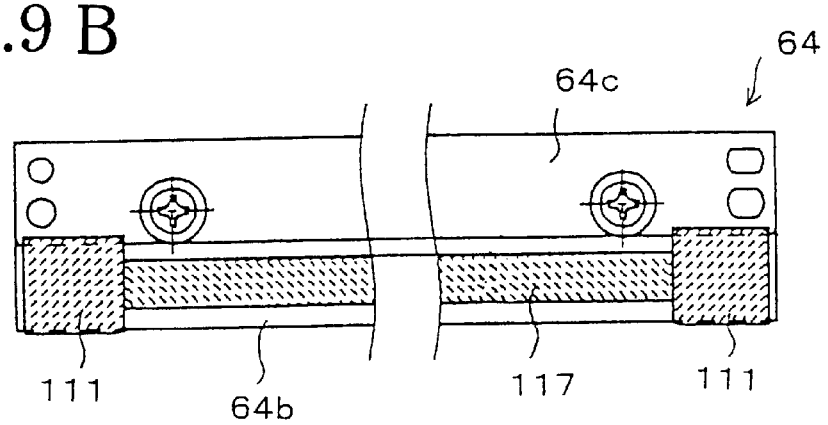
FIG. 9B is a rear view of the layer thickness-regulating blade onto which a spongy rib is mounted.
Figure 9C:
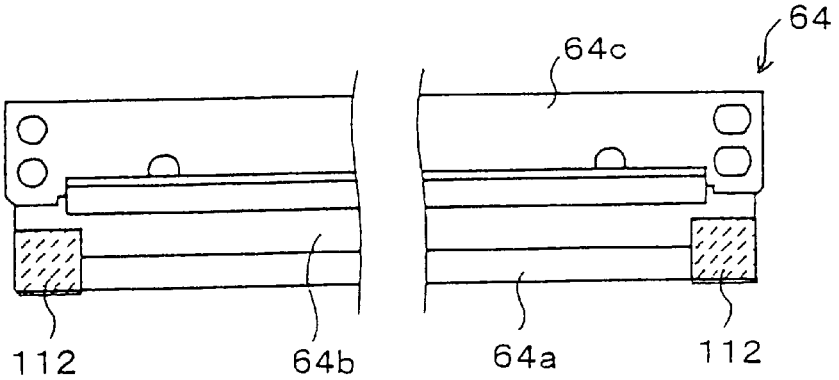
FIG. 9C is a front view of the layer thickness regulating blade.

As shown in FIGS. 9A to 9C, the layer thickness-regulating blade 64 is formed by providing a thin plate-shaped plate spring 64*b* made of phosphate copper or stainless steel to a support 64*c* made of iron or stainless steel. A pressing portion 64*a* made of a silicone rubber is mounted over the plate spring 64*b*. FIG. 9C is a front view as viewed from arrow A of FIG. 10, while FIGS. 9A and 9B are rear views as viewed from the opposite side.

The support 64*c* is attached to the case 51 by fitting a boss hole 115 to a boss 115*a* of the case 51 and by using a screw though a screw hole 116. After that, when the developing roller 59 is mounted in the case 51, the pressing member 64*a* is pressed into contact with a circumferential surface of the developing roller 59 by elastic forces of the plate spring 64*b* and the silicon rubber of the pressing member 64*a*. Thereby, the thickness of toner over the developing roller 59 is regulated to a desired value.

Positively charged non-magnetic one-component toner accommodated in the toner chamber 52 has a base particle of 6–10 $\mu$m in size and of 8 $\mu$m in mean size. The toner base particle is formed by adding a known coloring agent, such as carbon black, and a charge control additive, such as nigrosine, triphenylmethane, and quanterary ammonium salt, to a styrene acrylic resin, which is spherically formed by suspension polymerization. Silica is further added to the surface of the toner base particle.

The transfer roller 21 is rotatably supported and is formed by a conductive elastic foam made of a silicone rubber or a urethane rubber. The transfer roller 21 reliably transfers a toner image on the photosensitive drum 20 to a sheet of paper when a voltage is applied to the transfer roller 21.

A fixing unit 70 is provided along the sheet feed direction and downstream of the resist rollers 12, 13 and the contact portion of the photosensitive drum 20 and the transfer roller 21. The fixing unit 70 includes a heat roller 71 and a pressure roller 72. The toner image transferred to the sheet of paper is heated to be melted and pressed to be fixed thereto, while being conveyed by the heat roller 71 and the pressure roller 72.

A pair of conveying rollers 73 and a pair of sheet discharge rollers 74 are provided downstream of the fixing unit 70 along the sheet feed direction, and a discharged sheet tray 75 is provided downstream of the sheet discharge rollers 74.

The above-described photosensitive drum 20, transfer roller 21, charger 30, and developing device 50 are accommodated in a process cartridge 2*a*. The process cartridge 2*a* is detachably attached to the laser beam printer 1. Further, the developing device 50 is detachably attached, as a developing device cartridge, to the process cartridge 2*a*. The detailed structure of the process cartridge 2*a* is described in U.S. Pat. No. 6,041,203, which is herein incorporated by reference.

In the laser beam printer 1 according to the above-described embodiment, the surface of the photosensitive drum 20 is uniformly charged by the charger 30. Then, when the surface of the photosensitive drum 20 is irradiated with laser light L emitted from the laser scanning unit 40 and modulated based on image data, an electrostatic latent image is formed on the surface of the photosensitive drum 20. The electrostatic latent image is turned into a visible image with toner by the developing device 50. The visible image formed on the photosensitive drum 20 is conveyed by the photosensitive drum 20 to the transfer position, where a sheet of paper is fed by the sheet feed roller 11 and the resist rollers 12, 13. When a bias voltage is applied by the transfer roller 21 to the visible image, the image is transferred to the sheet of paper. Any toner left on the photosensitive drum 20 after image transfer is reclaimed by the developing roller 59 to the developing chamber 57.

Then, the sheet of paper is conveyed to the fixing unit 70, and pinched and conveyed by the heat roller 71 and the pressure roller 72 of the fixing unit 70. The visible image on the sheet of paper is pressed and heated to be fixed onto the sheet of paper. Then, the sheet of paper is discharged by the pair of conveying rollers 73 and the pair of sheet discharge rollers 74 to the discharged sheet tray 75 at an upper part of the laser beam printer 1, and thereby the image forming operation is completed.

Referring now to FIGS. 2 to 20, the sealing structure of the developing device 50 for preventing toner leaks will be described.

FIGS. 2A, 3A, 4A, 5A, 6A, 11A, 12A, and 15 are fragmentary perspective views each showing a sealing portion of the case 51 of the developing device 50.

FIGS. 2B, 3C, 4B, 5B, 6C, 8, 10, 11B, and 12C are views showing the sealing portion as viewed from the direction of arrow B shown in each of the fragmentary perspective views.

Figure 3A:
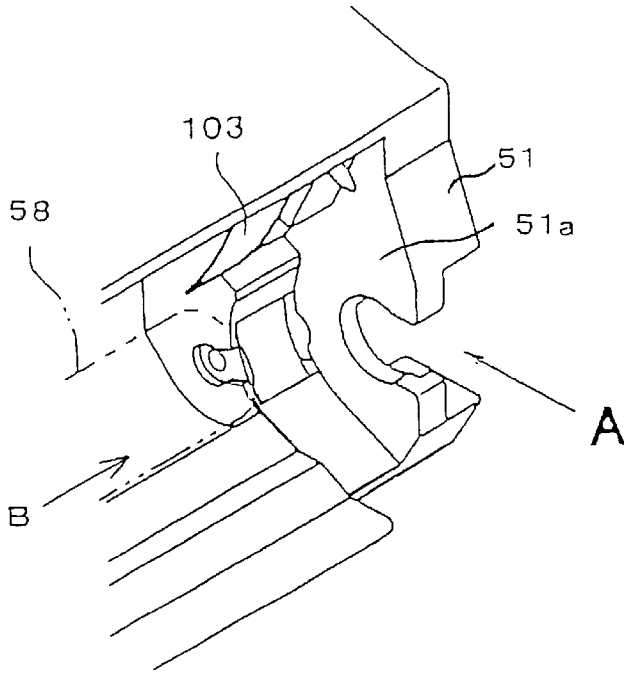
FIGS. 3A, 3B, and 3C show the sealing portion, in the developing device, onto which an upper side seal mounting film is mounted.
Figure 3B:
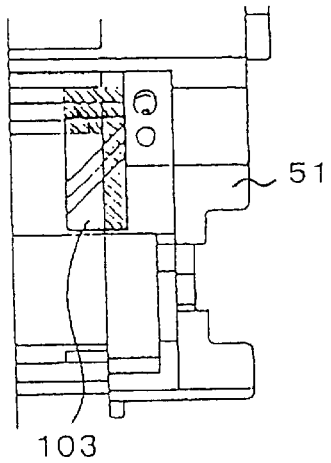
Figure 6A:
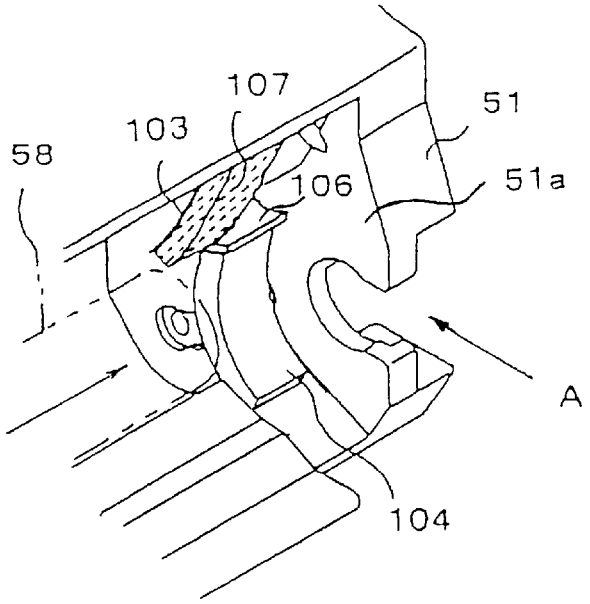
FIGS. 6A, 6B, and 6C show the sealing portion, in the developing device, onto which an upper side seal is mounted.
Figure 6B:
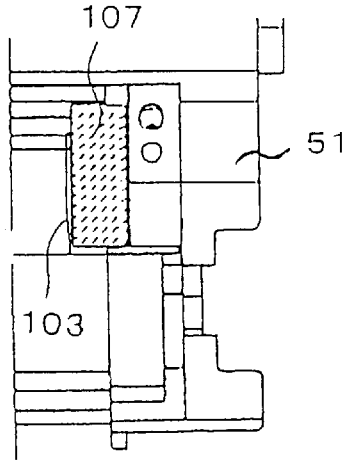
Figure 7:
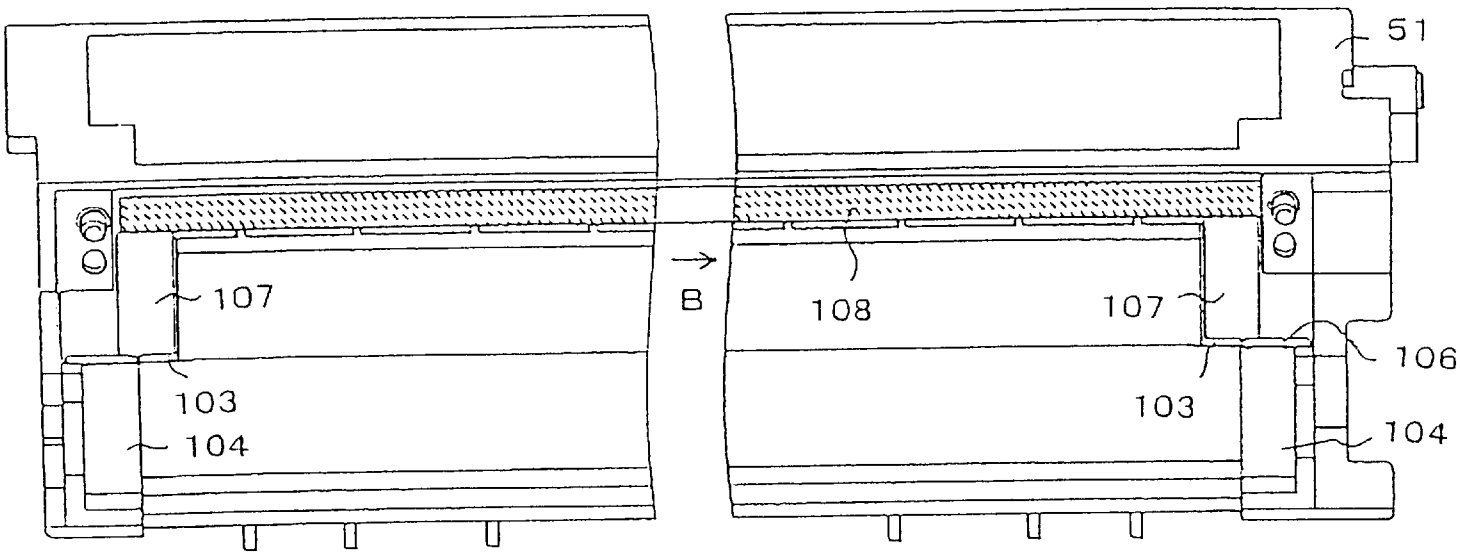
FIG. 7 is a front view showing a sealing portion, in the developing device, onto which an upper seal is mounted.
Figure 13:
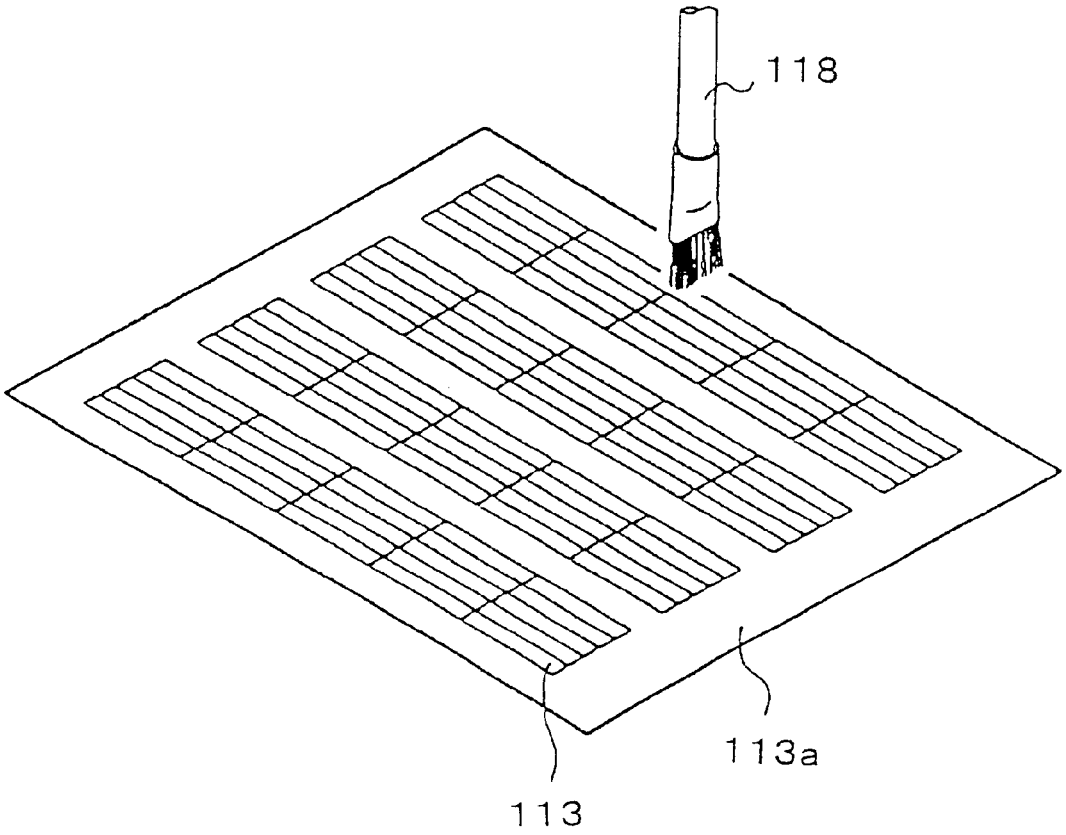
FIG. 13 illustrates how to apply a lubricating agent to a TEFLON® felt sheet.
Figure 14:
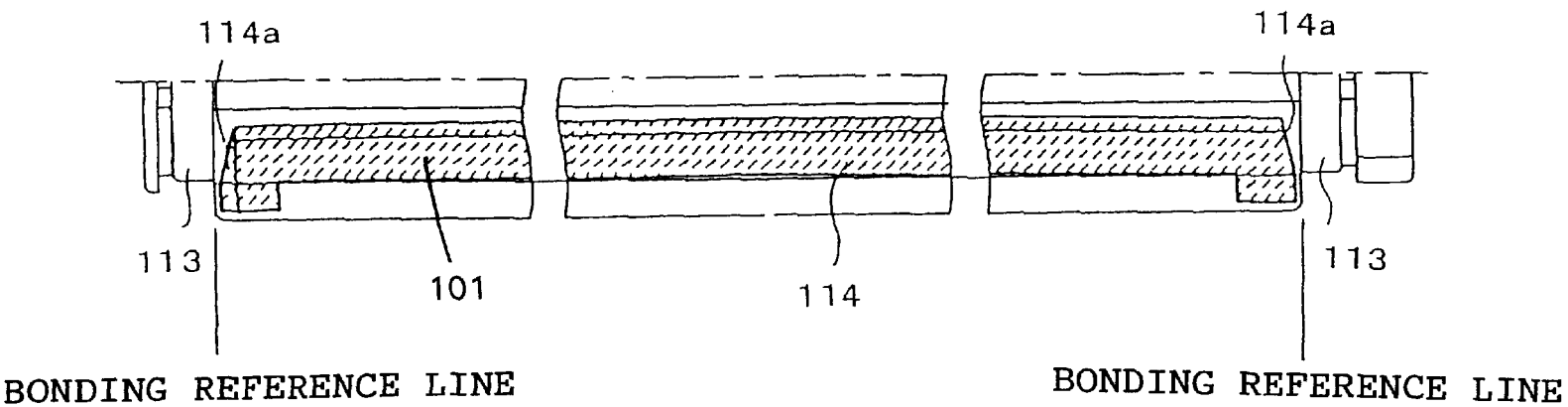
FIG. 14 is a plan view showing a lower film and a periphery of a lower film mounting portion.

FIG. 3B shows the sealing portion as viewed from the direction of arrow A shown in FIG. 3A. FIG. 6B shows the sealing portion as viewed from the direction of arrow A shown in FIG. 6A. FIG. 7 is a front view showing the sealing portion, of the case 51, onto which an upper seal is mounted. FIG. 9A is a view showing a layer thickness-regulating blade as viewed from its back. FIG. 9B shows the layer thickness-regulating blade with a spongy rib as viewed from its back. FIG. 9C shows the layer thickness-regulating blade as viewed from its front. FIG. 12B shows the sealing portion as viewed from the direction of arrow A shown in FIG. 12A. FIG. 12D is a sectional view taken along the line 12—12 of FIG. 12C. FIG. 13 illustrates a method for applying a lubricating agent to a TEFLON® felt sheet. FIG. 14 is a plan view showing a lower film and a periphery of the lower film mounting portion.

Figure 16A:
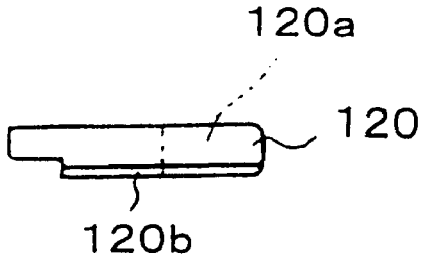
FIG. 16A is a front view showing a safeguard film.
Figure 16B:
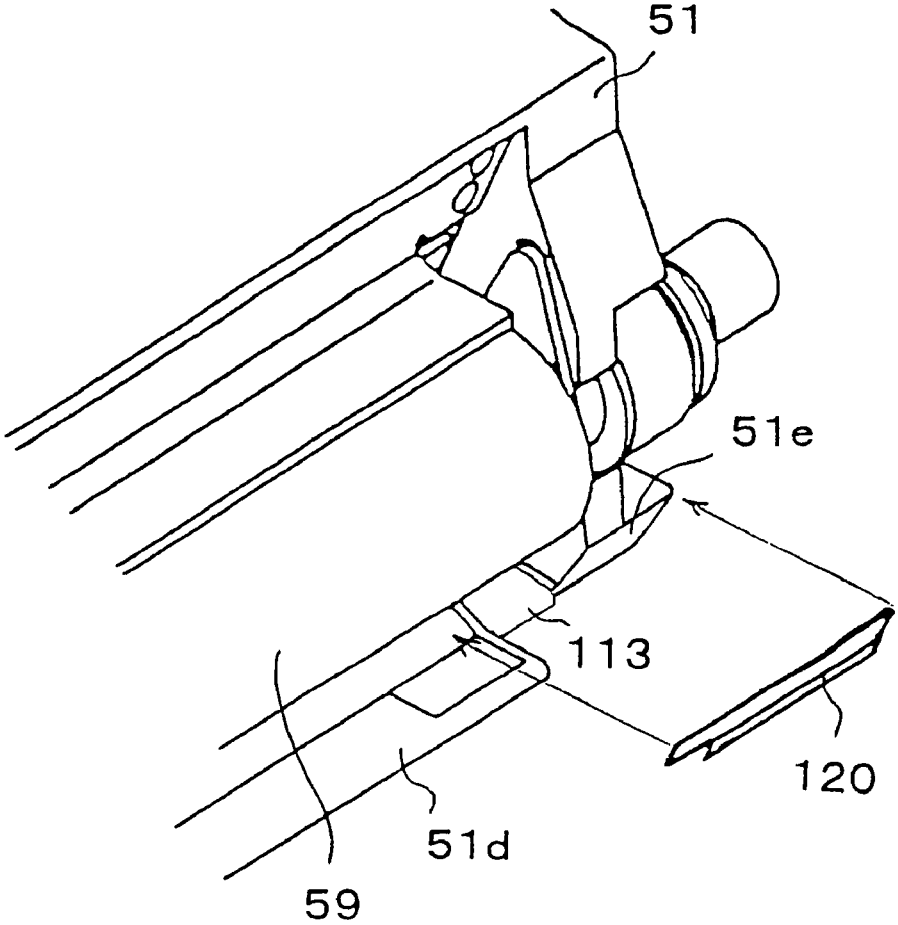
FIG. 16B shows a safeguard film mounting position.
Figure 17A:
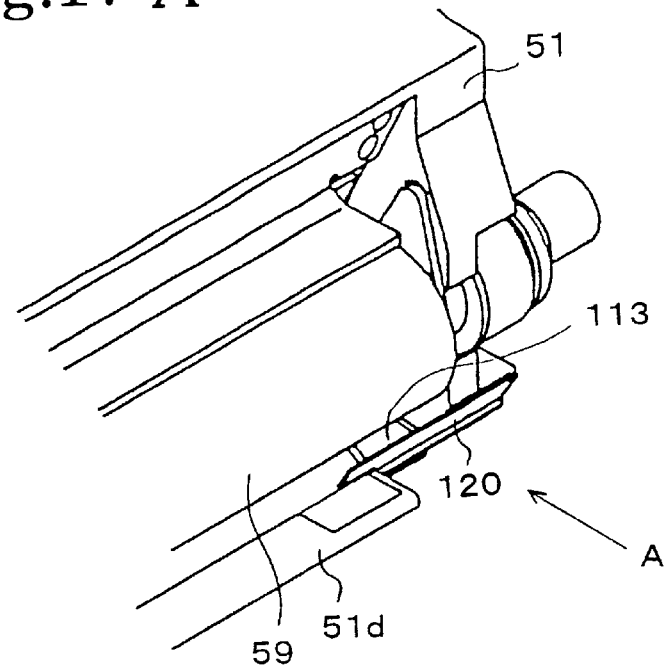
FIGS. 17A and 17B show a state where the safeguard film is mounted.
Figure 17B:
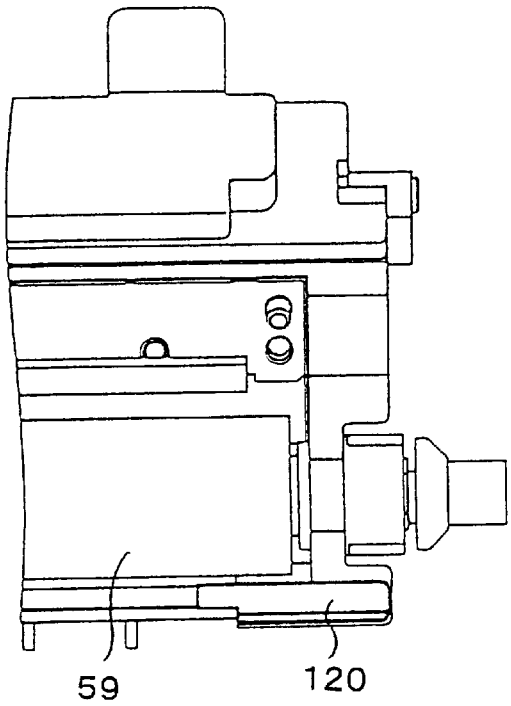
Figure 18A:
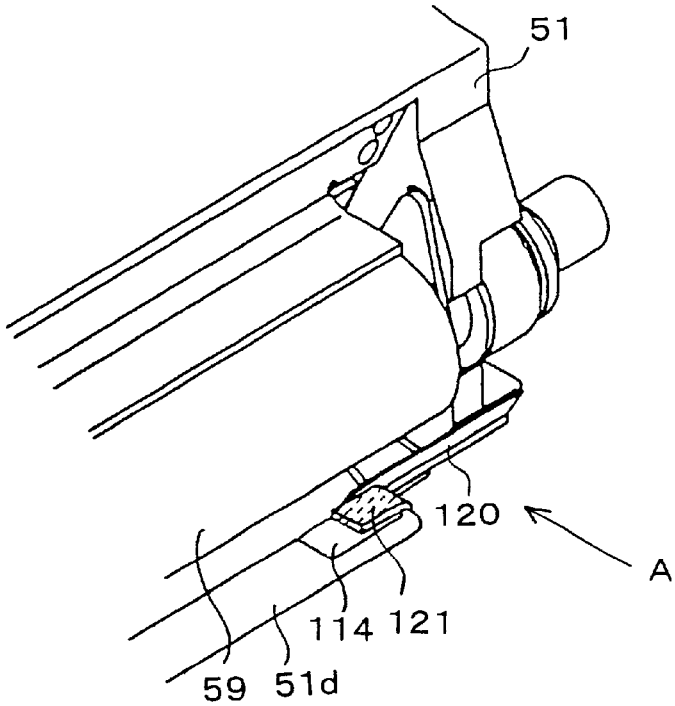
FIGS. 18A and 18B show a state where a front edge seal is mounted onto the front of the safeguard film.
Figure 18B:
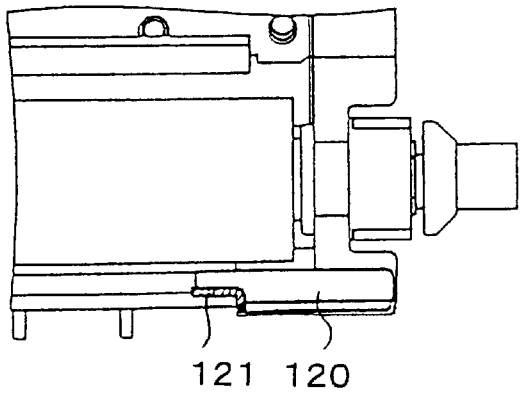
Figure 19A:
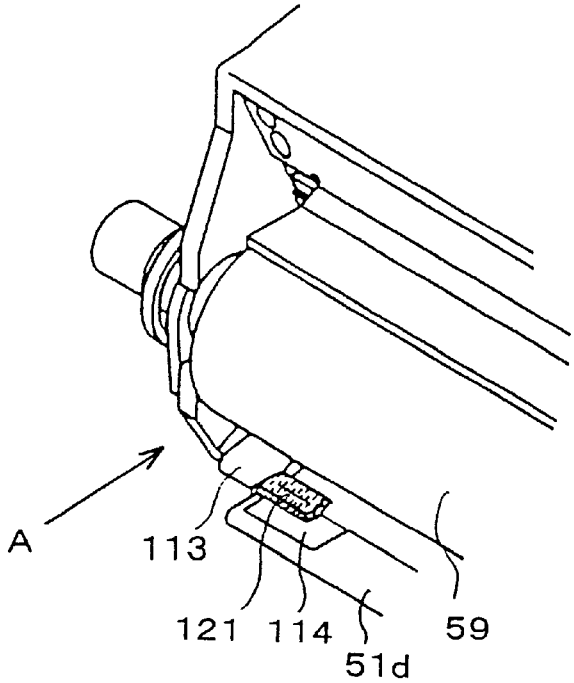
FIGS. 19A and 19B show a state where the front edge seal is mounted.
Figure 19B:
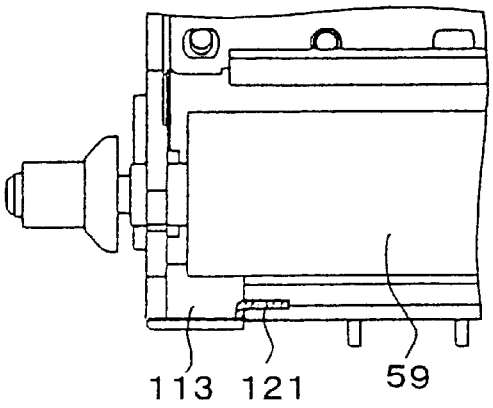
Figure 20A:
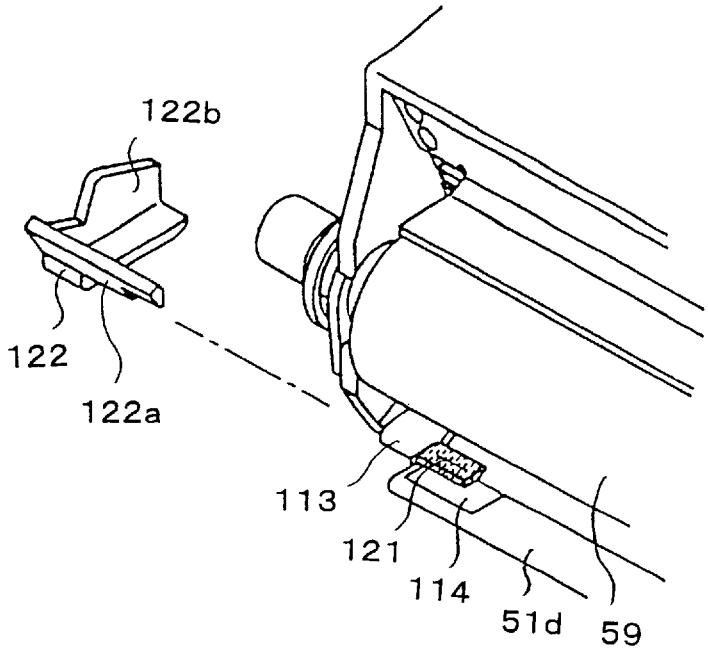
FIGS. 20A and 20B show a state where a safeguard member is about to be mounted.
Figure 20B:
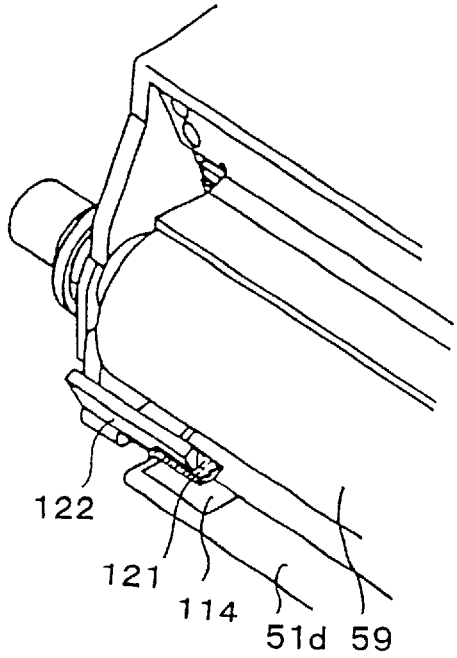

FIG. 16A is a front view showing a safeguard film forming a developing agent stopper, and FIG. 16B shows a safeguard film mounting position. FIG. 17A shows a state where the safeguard film is mounted onto the developing device 50, and FIG. 17B shows the developing device 50 as viewed from arrow A shown in FIG. 17A. FIG. 18A shows a state where a front edge seal is mounted onto a right front edge of the developing device 50, and FIG. 18B shows the developing device 50 as viewed from arrow A shown in FIG. 18A. FIG. 19A shows a state where a front edge seal is mounted onto a left front edge of the developing device 50, and FIG. 19B shows the developing device 50 as viewed from arrow A shown in FIG. 19A. FIG. 20A shows a safeguard member mounting position, and FIG. 20B shows a state where the safeguard member is mounted to the left front edge of the developing device 50.

Figure 2A:
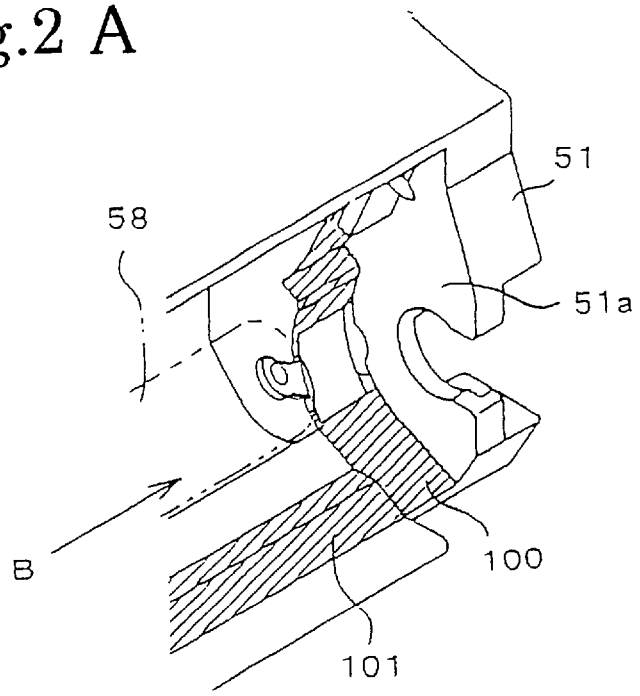
FIGS. 2A and 2B show a sealing portion, in a developing device, onto which no sealing members are mounted.
Figure 2B:
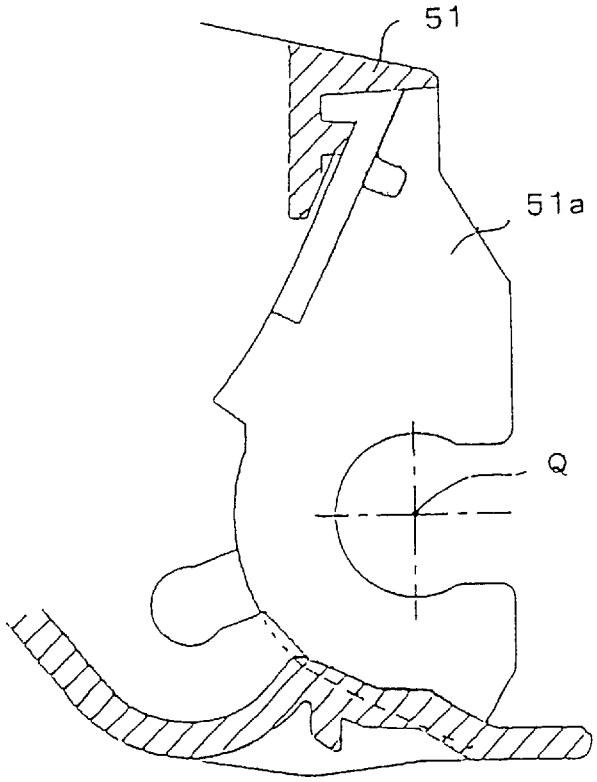

Diagonally shaded areas in FIG. 2A show the areas onto which sealing members to be described below are mounted using double-sided adhesive tape, and are divided into a side seal mounting area 100 extending along the circumferential direction of the developing roller 59, and a lower seal mounting area 101 extending below the developing roller 59, along the longitudinal direction thereof. The side seal mounting area 100 and the lower seal mounting area 101 are degreased to improve adhesion of double-sided adhesive tape.

As shown in FIG. 2A, the developing roller 59 is disposed such that its end face becomes adjacent to a side portion 51*a* of a developing roller accommodating portion of the case 51. A center point Q (FIG. 2B) shows a central rotation axis of the developing roller 59. The supply roller 58 is mounted in a supply roller accommodating portion provided behind the developing roller accommodating portion, as shown by a long and short dashed line of FIG. 2A.

Figure 3C:
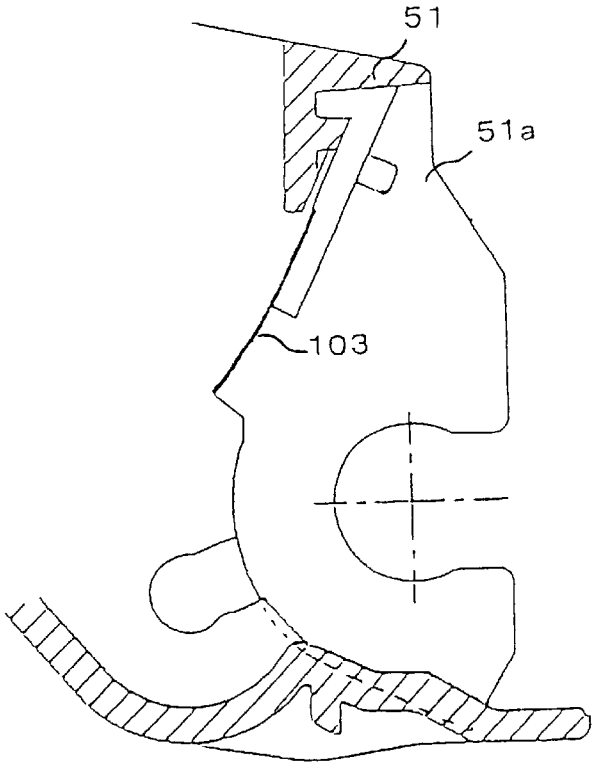

As shown next in FIGS. 3A, 3B, and 3C, an upper side seal mounting film 103 is bonded to the case 51 using double-sided adhesive tape. As described later, a layer thickness-regulating blade 64 mounted above the developing roller 59 is provided with blade side seals to prevent toner leaks from both ends of the developing roller 59. An upper side seal is mounted onto the case 51 so as to make intimate contact with the blade side seal. The upper side seal is mounted so as to be overlaid on the film 103 as shown in FIG. 3B. Without the film 103, the upper side seal is bonded to the case 51 only at a shaded area shown in FIG. 3B, and lacks stability. Thus, the PET film 103 is attached to the case 51 to provide a bonding area for the upper side seal.

Figure 4A:
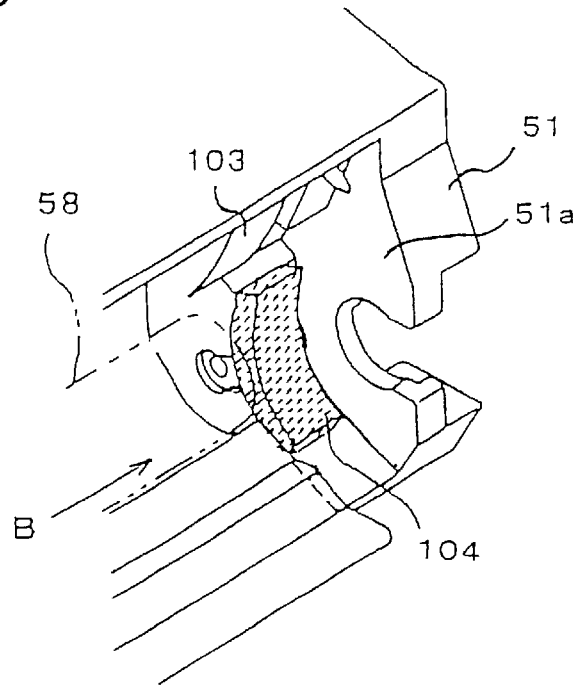
FIGS. 4A and 4B show the sealing portion, in the developing device, onto which a side seal is mounted.
Figure 4B:
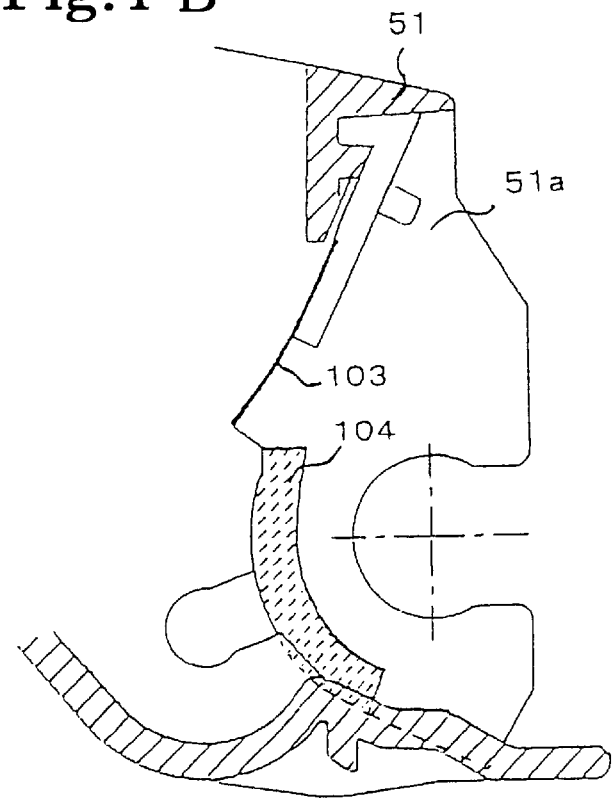

As shown next in FIGS. 4A and 4B, a side seal 104, as a base element of a both-side developing agent leak prevention member, is mounted onto the side seal mounting area 100 using double-sided adhesive tape to prevent toner leaks from each end of the developing roller 59.

The side seal 104 is made of a urethane spongy material (trade name: Poron, manufacturer: Rogers Inoac Corporation), which has relatively high rigidity among spongy materials, to a certain thickness to generate a predetermined pressing force when compressed by the developing roller 59 mounted in position. With this structure, a TEFLON® (polytetrafluoroethylene) felt member at the uppermost layer of each side developing agent leak prevention member can be pressed against the developing roller 59 by a predetermined pressing force.

In this embodiment, as shown in FIG. 4A, the side end face of the supply roller 58 is designed to make sliding contact with the side end face of the side seal 104 to prevent toner leaks from between the supply roller 58 and the side seal 104.

Figure 5A:
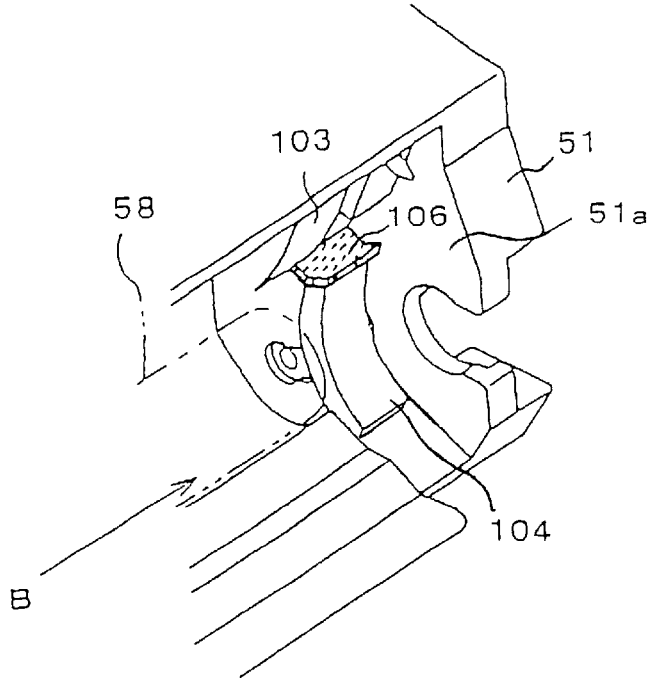
FIGS. 5A and 5B show the sealing portion, in the developing device, onto which an edge seal is mounted.
Figure 5B:
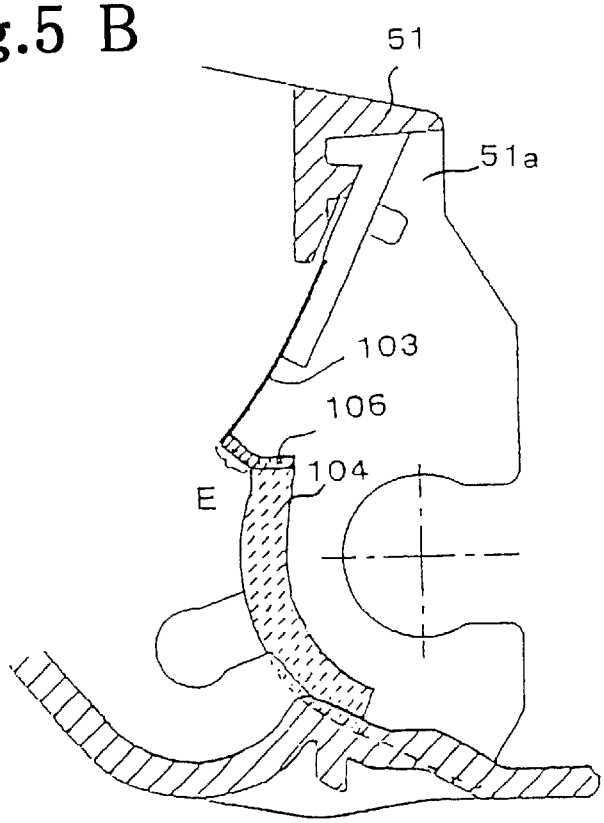

As shown next in FIGS. 5A and 5B, an edge seal 106 is mounted over a step E, which is formed between a bonding surface of the side seal 104 and a bonding surface of the film 103 of the case 51, and over the upper end face of the side seal 104. The edge seal 106 is made of a urethane spongy material, and its bottom surface is bonded to the step E and the upper end face of the side seal 104, using double-sided adhesive tape. Such an edge seal 106, if provided, makes contact with the adhesive-free lower end face of the upper side seal mounted over the film 103 and the adhesive-free lower end face of the blade side seal mounted onto the layer thickness-regulating blade. Thus, spongy materials make contact with each other, and can reliably prevent toner leaks.

Figure 6C:
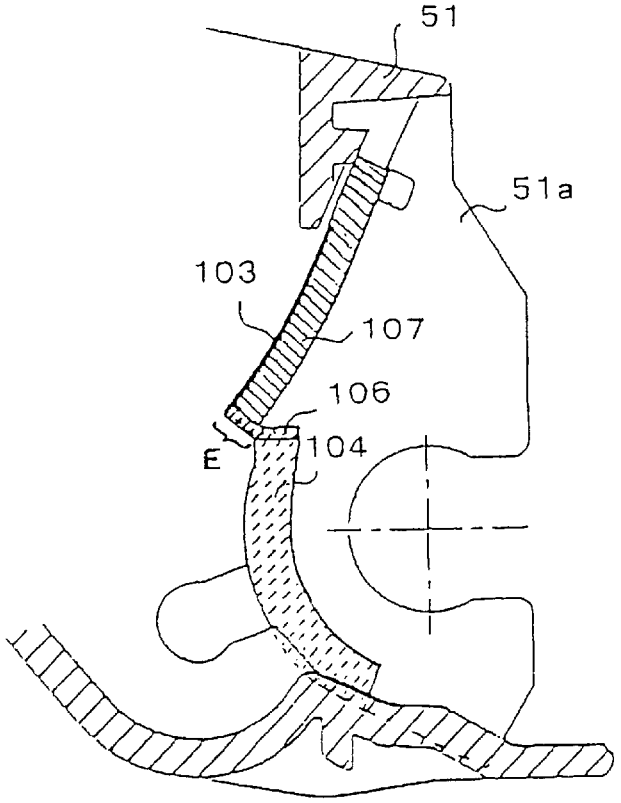

As shown next in FIGS. 6A, 6B, and 6C, AN upper side seal 107 is bonded to the film 103 and the case 51 using double-sided adhesive tape so as to make intimate contact with the blade side seal to be described later. The upper side seal 107 is made of a urethane spongy material and disposed so as to come into contact with the blade side seal to be described later. With this structure, when the upper side seal 107 makes contact with the blade side seal, spongy materials make contact with each other to reliably prevent toner leaks.

Figure 8:
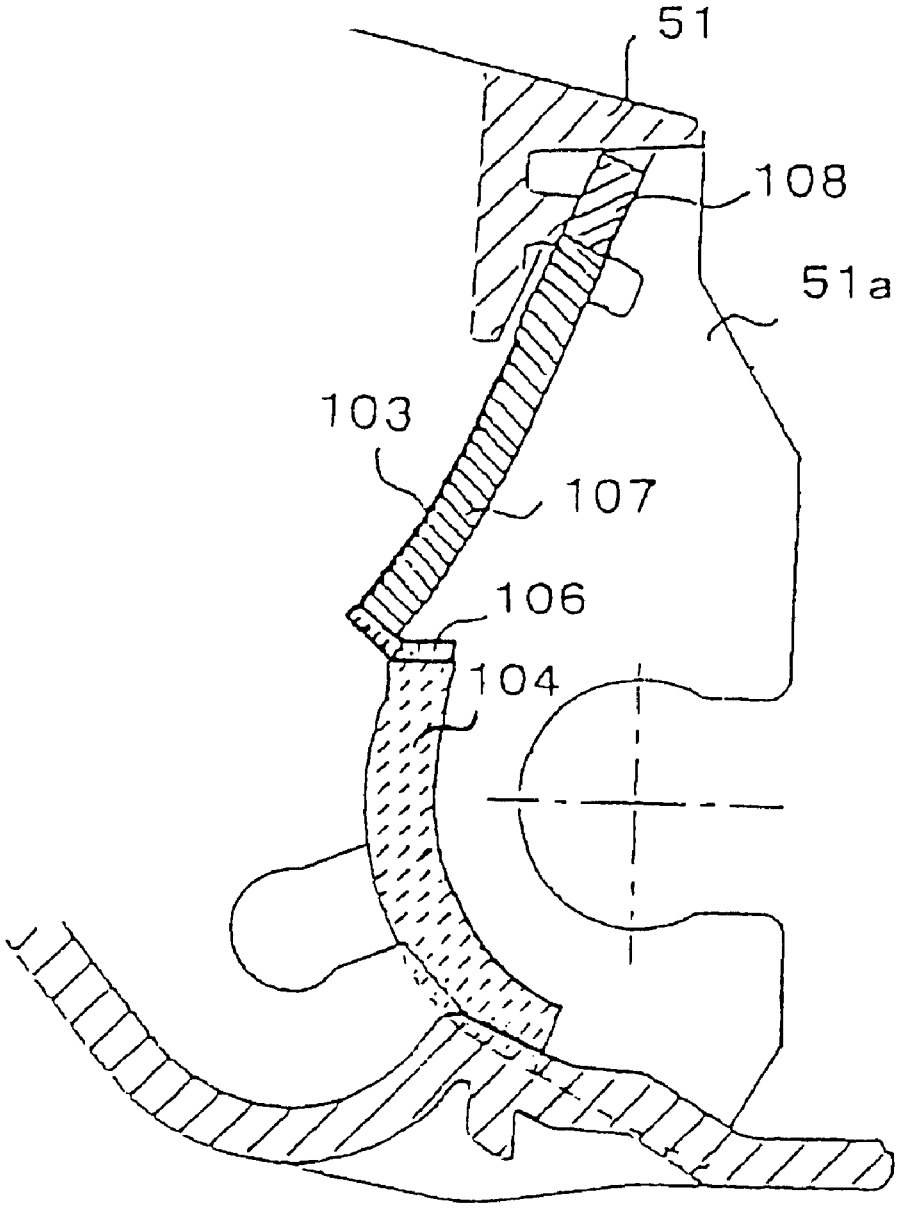
FIG. 8 shows the sealing portion as viewed from arrow B of FIG. 7.

As shown next in FIGS. 7 and 8, an upper seal 108, which extends in the longitudinal direction of the layer thickness-regulating blade 64, is mounted to prevent toner leaks from the upper position behind the mounting portion of the layer thickness-regulating blade 64. The upper seal 108 is made of a urethane spongy material. The upper seal 108 can reliably prevent misty flying toner in the toner chamber from leaking or prevent toner from leaking when the developing device 50 is inverted.

Figure 10:
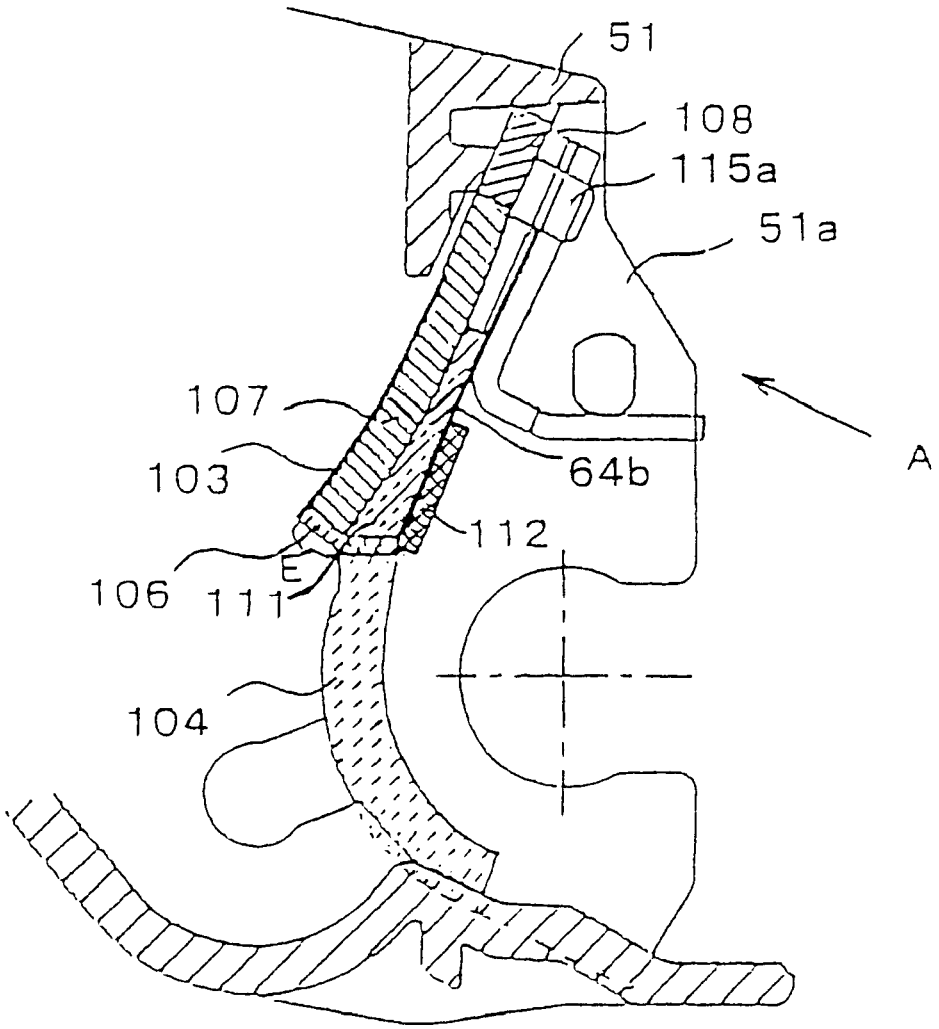
FIG. 10 shows the sealing portion as viewed from arrow B of FIG. 7.
Figure 11A:
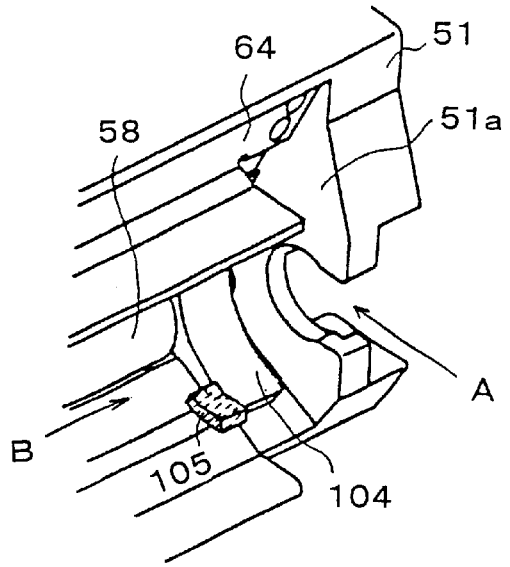
FIGS. 11A and 11B show the sealing portion, in the developing device, onto which a lower side seal is mounted.
Figure 11B:
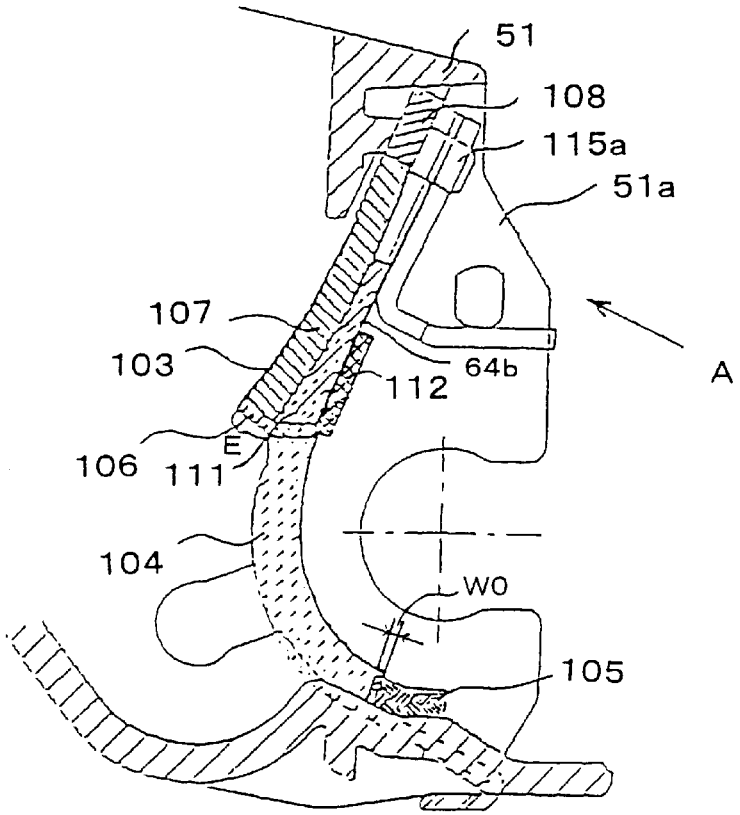

As shown next in FIG. 9A, rear-facing blade side seals 111 are bonded to the plate spring 64*b* mounted on an support portion 64*c* of the layer thickness-regulating blade 64, using double-sided adhesive tape. As shown in FIG. 11B, when the layer thickness-regulating blade 64 is mounted onto the case 51, the plate spring 64*b* receives, at each end thereof, pressing forces from the upper side seal 107 and the rear-facing blade side seal 111. However, as the rear-facing blade side seal 111 is wide enough to press not only the plate spring 64*b* but also the end portion of the pressing member 64*a*, the plate spring 64*b* is not bent. Thus, toner leaks due to a bend of the plate spring 64*b* can be prevented. Double-sided adhesive tape is affixed to a bonding surface of the rear-facing blade side seal 111 and to the plate spring 64*b*, while the opposite surface thereof is pressed into contact with the upper side seal 107, as shown in FIG. 10. When the rear-facing blade side seal 111, which is made of a urethane spongy material, makes contact with the upper side seal 107, spongy material-to-spongy material contact occurs. In addition, as shown in FIG. 10, the lower end face of the rear-facing blade side seal 111 makes contact with the edge seal 106. Spongy material-to-spongy material contact occurs therebetween. In this way, at the boundaries between the rear-facing blade side seal 111 and other members, except for between the rear-facing blade side seal 111 and the plate spring 64*b*, spongy materials make contact with each other. Thus, toner leaks are reliably prevented.

In addition, as shown in FIG. 9B, a spongy rib 117 is affixed, using double-sided adhesive tape, to an area between the two rear-facing blade side seals 111 such that the spongy rib 117 extends in the longitudinal direction of the plate spring 64*b*. The spongy rib 117 is made of a urethane spongy material thicker than the rear-facing blade side seals 111. As shown in FIG. 1, a rib 51*b* is provided behind the layer thickness-regulating blade 64 in the developing chamber 57 of the case 51. When the layer thickness-regulating blade 64 is mounted in the case 51, the spongy rib 117 is pressed into contact with the rib 51*b*. Thus, toner entry to the rear of the layer thickness-regulating blade 64, and accumulation of uncharged toner at the back portion is prevented. As a result, filming caused by uncharged toner falling from the back portion is prevented.

On the other hand, on the front side of the layer thickness-regulating blade 64, where the pressing member 64*a* is provided on the plate spring 64*b*, front-facing blade side seals 112 are mounted, using double-sided adhesive tape, so as to make contact with both ends of the pressing member 64*a*. The front-facing blade side seals 112 are made of a urethane spongy material. A TEFLON® felt member 113 is attached to each front-facing blade side seal 112. As shown in FIG. 12D, the front-facing blade side seal 112 with the TEFLON® felt member 113 is designed to be thicker than the pressing member 64*a* by anticipating they are compressed to a certain degree. With this structure, even when the pressing member 64*a* wears out, the pressing force at both ends of the pressing member 64*a* against the developing roller 59 remains unchanged. Thus, toner leaks from the portion where the pressing member 64*a* is pressed into contact with the developing roller 59 can be reliably prevented.

As shown next in FIGS. 11A and 11B, a lower side seal 105 is mounted, using double-sided adhesive tape, to an end portion of the lower seal mounting area 101 to prevent toner leaks from the boundary between the lower seal mounting area 101 and the side seal mounting area 100, and from a gap between a lower film movable portion to be described later and the lower seal mounting area 101. The lower side seal 105 is made of a urethane spongy material, and the double-sided tape is affixed to its bottom surface. The lower side seal 105 partially overlaps, at its end face opposed to the side seal 104, the side seal 104 by a distance of W0, and the lower side seal 105 is pressed into contact with the side seal 104. In this embodiment, the overlapping distance W0 is set to approximately 2 mm.

Figure 12A:
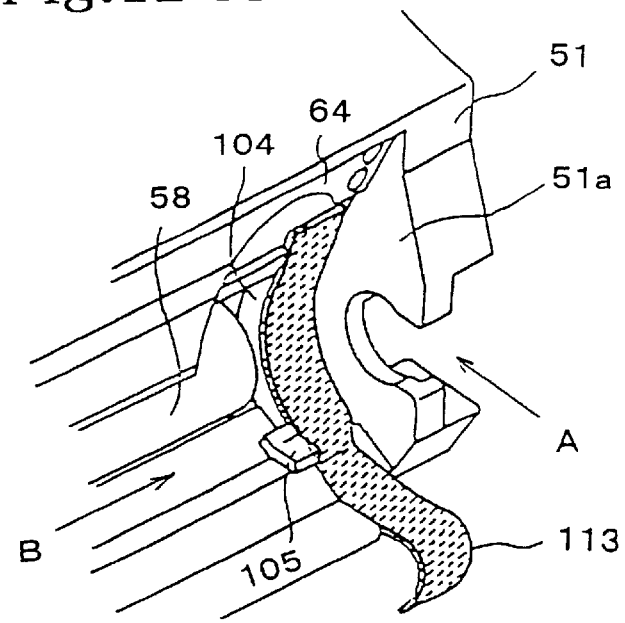
FIGS. 12A, 12B, 12C, and 12D show the sealing portion, in the developing device, onto which a TEFLON® (polytetrafluoroethylene) felt member is mounted.
Figure 12B:
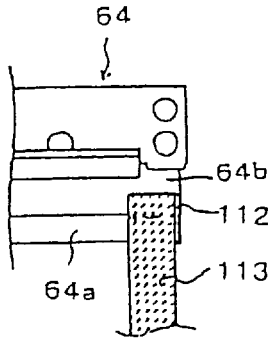
Figure 12C:
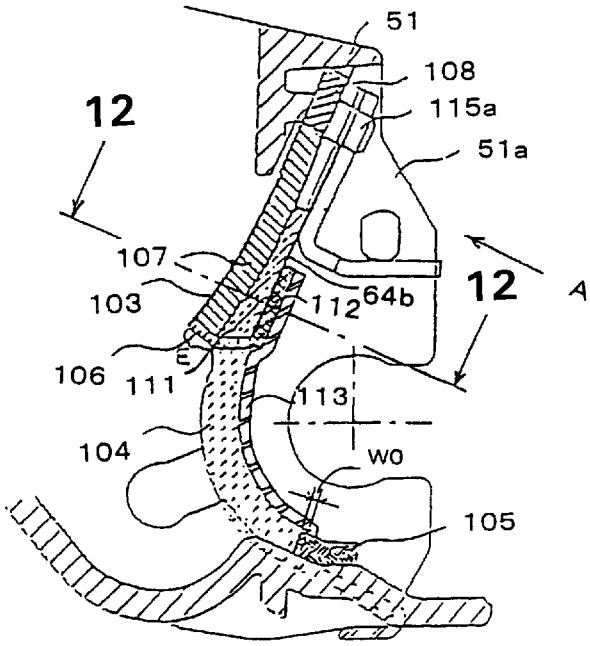
Figure 12D:
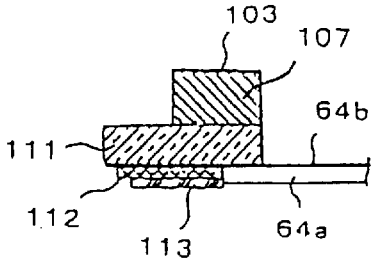

As shown next in FIGS. 12A, 12B, and 12C, a TEFLON® felt member 113, as a sliding contact portion of the both-side developing agent leak prevention member, is mounted, using double-sided adhesive tape, over the plate spring 64*b* of the layer thickness-regulating blade 64, the front-facing blade side seal 112, and the side seal mounting area 100. On the layer thickness-regulating blade 64, as shown in FIGS. 12B and 12C, the leading edge of the TEFLON® felt member 113 is affixed to and covers the front-facing blade side seal 112. With this structure, toner leaks from either end of the pressing member 64*a* of the layer thickness-regulating blade 64 can be reliably prevented.

Particularly, in this embodiment, as shown in FIG. 13, before a TEFLON® felt sheet 113*a* is cut into TEFLON® felt members 113, a lubricating agent made by dispersing a fluorine oil and a fluorine-based resin in a fast-drying solvent is applied to the TEFLON® felt sheet 113*a* with a brush 118. Then, TEFLON® felt members 113 in the form of strips, as shown in FIG. 13, are cut from the TEFLON® felt sheet 113*a* and mounted as described above. As a result, toner leaks from the sliding contact portion between the developing roller 59 and the TEFLON® felt member 113 are prevented more effectively. In addition, as the sliding contact portion becomes more lubricative, noise generated from the sliding contact portion can be reliably controlled when the developing roller is rotationally driven.

To be more specific about the lubricating agent, a lubricating agent made by Kanto Kasei Ltd. and known under the trade name "Hanarl FL-Z75" is used in this embodiment. 20±5 g of lubricating agent is applied per 100 TEFLON® felt members 113. The Hanarl FL-Z75 contains 80–90 wt % hydrofluorocarbon, as a volatile solvent, and 10–20 wt % polytetrafluoroethylene (PTFE) and other components, as a fluorine oil and a fluorine-based resin.

As the Hanarl FL-Z75 contains such components, it is fast-drying, very easy to apply, and provides a uniform finish. Further, the Hanarl FL-Z75 is a semiwet lubricating agent and highly lubricative. Thus, it produces a high noise reducing effect when the TEFLON® felt member makes sliding contact with the developing roller 59. In addition, the fluorine-based resin penetrates fibers of the TEFLON® felt member 113, and thus the TEFLON® felt member 113 can produce a higher sealing effect.

The Hanarl FL-Z75 is just an example. Another lubricating agent made by Kanto Kasei Ltd. and known under the trade name "Hanarl FL-955" may be used. The Hanarl FL-955 contains 85–95 wt % perfluoroalkane, as a volatile solvent, and 5–15 wt % polytetrafluoroethylene (PTFE) and other components, as a fluorine oil and a fluorine-based resin. Compared to the Hanarl FL-Z75, the Hanarl FL-955 has a lower content of a fluorine oil and a fluorine-based resin and thus has a somewhat inferior noise reducing effect, but it can produce a higher noise reducing effect and sealing effect than conventional lubricating agents.

In this embodiment, as shown in FIGS. 12B, 12C, and 12D, the TEFLON® felt member 113 is disposed at the side end face of the pressing member 64*a* so as to be overlaid on the plate spring 64*b*. Thus, fibers of the TEFLON® felt will not enter the portion where the pressing member 64*a* is pressed into contact with the developing roller 59, and no gap will be formed therebetween. As a result, toner leaks from the boundary between the pressing member 64*a* and the developing roller 59 can be reliably prevented. Further, as described above, the TEFLON® felt member 113 overlaid on the plate spring 64*b* moves as the plate spring 64*b* of the layer thickness-regulating blade 64 moves, and will not interfere with the movement of the plate spring 64. In addition, in this embodiment, as shown in FIGS. 12C and 12D, at the portion where the TEFLON® felt member 113 is overlaid on the plate spring 64*b*, the front-facing blade side seal 112 formed by a spongy material, which is provided separately from the side seal 104, is interposed between the plate spring 64*b* and the TEFLON® felt member 113. The TEFLON® felt member 113 is bonded to the front-facing blade side seal 112 using double-sided adhesive tape. As a result, when the TEFLON® felt member 113 is pressed into contact with the developing roller 59 by a sufficient pressing force to prevent toner leaks from each end of the developing roller 59, the front-facing blade side seal 112 having an appropriate complessiblility absorbs a bounce from the contact portion. Thus, the pressing force of the pressing member 64*a* of the layer thickness-regulating blade 64 against the developing roller 59 will not be weakened at each end of the developing roller 59.

Figure 15:
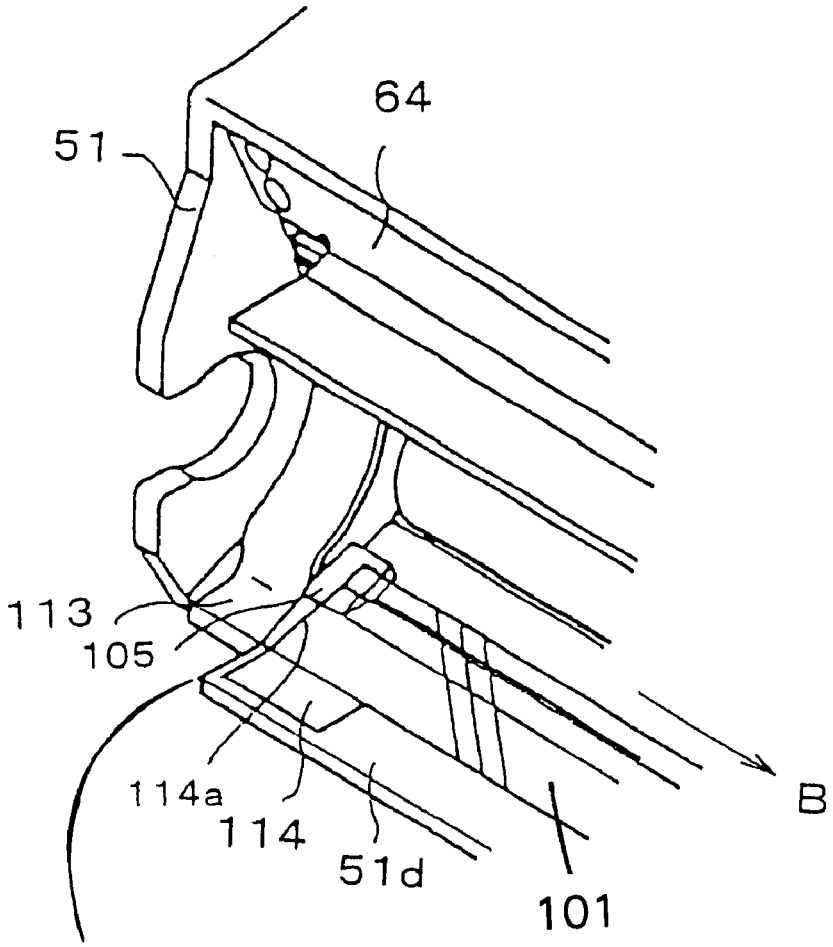
FIG. 15 is a fragmentary perspective view showing a sealing portion, in the developing device, onto which the lower film is mounted.

As shown in FIGS. 14 and 15, a lower film 114 is mounted onto the case 51 to prevent toner leaks from the lower end of the developing device 50. A PET (polyethylene terephthalate) seat or a urethane rubber is used for the lower film 114. The urethane rubber can press softly, but is not stiff enough and needs to be backed by a spongy material. The PET seat has advantages that the PET seat is stiffer than the urethane rubber and does not require backing. Thus, the PET seat is easier to assemble than the urethane rubber.

In this embodiment, a PET seat is used as the lower film 114. The lower film 114 is bonded, using double-sided adhesive tape, to a part of the lower seal mounting area 101, a part of a front edge 51*d* of the case 51, and a part of the lower side seal 105. In this way, as the bonding surface of the lower film 114 extends over not only the lower seal mounting area 101 but also the front edge 51*d* area, the lower film 114 hardly peels. Thus, even when the pressing forces of the developing roller 59, the lower film 114, and the TEFLON® felt member 113 increase to a certain extent, the lower film 114 is reliably prevented from peeling.

In addition, both ends 114*a* of the lower film 114 are formed diagonally with respect to the bonding reference lines, as shown in FIGS. 14 and 15. As a result, gaps are formed between the ends 114*a* and the TEFLON® felt members 113, and the lower side seals 105 are exposed through the gaps. Thus, as the lower film 114 is not overlaid on the TEFLON® felt members 113, no stepped gaps are created between the developing roller 59 and the TEFLON® felt members 113, and toner leaks from the contact portions between the TEFLON® felt members 113 and the lower film 114 can be reliably prevented.

As shown next in FIG. 16B, after the developing roller 59 is mounted in the case 51, a safeguard film 120 is attached to the front of the TEFLON® felt member 113 disposed at the lower right end of the case 51. The safeguard film 120 is made of a PET film and partially cut away, as shown in FIG. 16A, along the lower-end front edge 51*d* of the case 51.

The safeguard film 120 includes an area 120*a* facing a lower flat portion 51*e* of the case 51, shown in FIG. 16B, and a lower end 120*b*. The back of the area 120*a* and the back of the lower end 120*b* are affixed to the case 51 using double-sided adhesive tape, as shown by arrows in FIG. 16B. FIGS. 17A and 17B show a state where the safeguard film 120 is affixed. The safeguard film 120 affixed to the case 15 provides a toner stopper in the areas ahead of the TEFLON® felt member 113 and the side seal 104. In the unlikely event that toner leaks from the TEFLON® felt member 113, the side seal 104, or the lower side seal 105, toner is stopped by the toner stopper, causing no contamination with toner.

Further, as shown in FIGS. 18A and 18B, a front edge seal 121 is affixed to the lower-end front edge 51*d* of the case 51 and the lower film 114. The front edge seal 121, made of a urethane spongy material, is affixed, using double-sided adhesive tape, to the lower-end front edge 51*d*, the lower film 114, and the safeguard film 120 so as to be pressed into contact them. Thus, toner leaks from a gap formed between the safeguard film 120 and the lower-end front edge 51*d* or the lower film 114 are reliably prevented.

As shown next in FIGS. 19A and 19B, a front edge seal 121 is affixed also to the lower-end front edge 51*d* and the lower film 114 on the left side of the case 51.

Then, as shown in FIGS. 20A and 20B, a safeguard member 122 is mounted onto the front of the TEFLON® felt member 113 provided at the lower left end of the case 51.

The safeguard member 122 is made of resin as the case 51 is, and, as shown in FIG. 20A, a guard portion 122*a* and a mounting portion 122*b* are integrally formed. The safeguard member 122 is mounted onto the left side face of the case 51 using double-sided adhesive tape affixed to the mounting portion 122*b*. The tip of the guard portion 122*a* is overlaid on the front edge seal 121.

On the left side of the case 51 structured as described above, a toner stopper is formed by the case 51 and the safeguard member 122 in the areas ahead of the TEFLON® felt member 113 and the side seal 104. In the unlikely event that toner leaks from the TEFLON® felt member 113, the side seal 104, or the lower side seal 105, toner is stopped by the toner stopper, causing no contamination with toner. Further, toner leaks from a gap formed between the safeguard member 122 and the lower-end front edge 51*d* or the lower film 114 are reliably prevented by the front edge seal 121.

As described above, in the developing device 50 according to the embodiment, toner leaks from the top, both ends, and the bottom of the developing roller 59 can be reliably prevented.

Particularly, in this embodiment, the TEFLON® felt member 113 to which a lubricating agent containing a fluorine oil and a fluorine-based resin is applied is used for a sliding contact portion of the side seal. Accordingly, the toner leak preventing effect at the sliding contact portion between either end of the developing roller 59 and the TEFLON® felt member can be improved compared to a normal TEFLON® felt member. In addition, the TEFLON® felt member 113 can be highly lubricative compared to the normal TEFLON® felt member, thereby reliably preventing noise generated from the sliding contact portion when the developing roller 59 rotates.

Further, in this embodiment, as described above, the safeguard film 120 and the safeguard member 122 are mounted to the lower-end right and left front edges, respectively. Thus, they can stop the leaking toner even when toner leaks when the process cartridge 2*a* receives a great impact during its mounting/dismounting, causing no contamination of an operator's hands or the inside of the printer with the toner.

Particularly, polymerized toner used in this embodiment has excellent flowability and is likely to leak compared to pulverized toner. However, as described above, the safeguard film 120 and the safeguard member 122 have excellent results in the prevention of contamination with the toner.

The safeguard film 120 and the safeguard member 122 are not necessarily mounted, as a separate member, to the case 51 of the developing device 50. Instead, the case 51 may be shaped to serve as the safeguard film 120 and the safeguard member 122.

Figure 21:
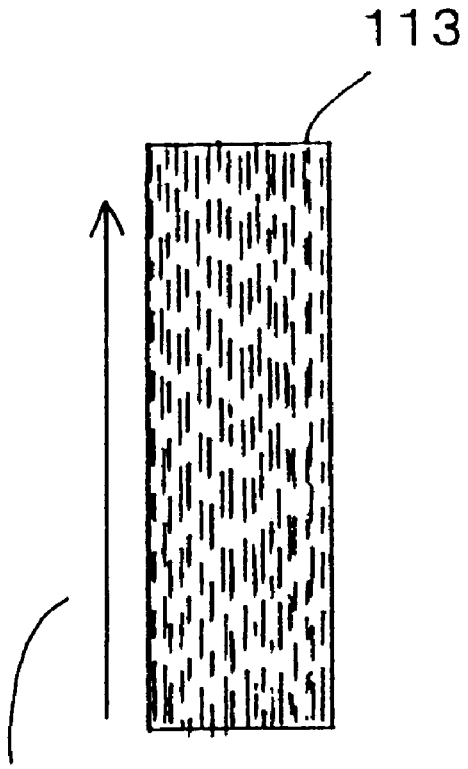
FIG. 21 illustrates the direction of individual TEFLON® felt fibers.

Referring now to FIG. 21, a modification in the invention will be described.

In this modification, the direction of fibers on the surface of the TEFLON® felt member 113 is aligned with the rotation direction of the developing roller 59 before the TEFLON® felt member 113 is mounted in the same manner as described in the embodiment above.

In order to prepare the TEFLON® felt member 113 used in this embodiment, a lubricating agent made by dispersing a fluorine oil and a fluorine-based resin in a fast-drying solvent is applied to the TEFLON® felt sheet 113*a* as shown in FIG. 13. After that, the TEFLON® felt members 113, in the form of strips as shown in FIG. 13, are cut from the TEFLON® sheet 113*a* piece by piece, and are assembled to the developing device 50, as described in the embodiment above. More specifically, the TEFLON® felt members 113 are affixed to the side seals 104 using double-sided adhesive tape. Then, the developing roller 59 as a jig is mounted such that the developing roller 59 makes contact with the TEFLON® felt members 113. At this time, the developing device 50 should not be filled with toner. The contact pressure between the developing roller 59, used as a jig, and the TEFLON® felt members 113 should be the same as in the developing device 50 of the above-described embodiment.

Then, the developing roller 59 is rotated at a higher speed than the developing roller 59 actually rotates in use in the laser printer 1. The jig developing roller 59 is rotated for a period long enough to align the fibers of the TEFLON® felt member 113 with the rotation direction of the developing roller 59.

After that, the jig developing roller 59 is removed. Then, the developing device 50 is assembled according to a normal assembling process and is charged with toner.

As described above, as the fibers of the TEFLON® felt members 113 are previously aligned with the rotation direction of the developing roller 59, and the lubricating agent (Hanarl FL-Z75) made by dispersing a fluorine oil and a fluorine-based resin in a fast-drying solvent is applied to the fibers, the TEFLON® felt members 113 can reliably seal the toner entering perpendicularly to the rotation direction of the developing roller 59, that is, to the direction of the fibers of the TEFLON® felt members 113. As a result, the toner sealing ability at the portions where the TEFLON® felt members 113 are pressed into contact with the developing roller 59 can be remarkably improved compared to the case where the direction of the TEFLON® felt fibers is not considered.

The toner sealing ability of the TEFLON® felt members 113 can be improved even when the TEFLON® members 113 are prepared by rotating at the same speed as when the developing roller 59 actually rotates in the laser printer 1. However, it is has been proven, from an experimental result, that when the rotation speed is higher, the TEFLON® felt fibers are aligned more easily and gain a higher toner sealing ability.

TEFLON® felt fibers are basically in a tangle and not unidirectionally aligned. Accordingly, when the TEFLON® felt members 113 are mounted onto the developing device 50 without consideration of the direction of the TEFLON® felt fibers, the TEFLON® felt fibers are gradually aligned with the rotation direction of the developing roller 59 with use of the developing device 50. However, some toner may enter the TEFLON® felt members 113 before their fibers are aligned. Once the toner enters the TEFLON® felt members 113, it becomes difficult to align the fibers with the rotation direction of the developing roller 59. As a result, some toner may leak with years of use of the developing device 50.

In contrast, the fibers of the TEFLON® felt members 113 of this modification are aligned with the rotation direction of the developing roller 59 before the toner is charged. In addition, the lubricating agent (Hanarl FL-Z75) is filled between the unidirectionally aligned fibers. Thus, entry of the toner can be reliably prevented.

As a result of an experiment in which printing was performed by the developing device 50 according to this modification at a print area rate of 4% on an A4 size paper, up to 6000 sheets were printed without any toner leaks. Usually, the amount of toner charged into the developing device 50 allows 5000–6000 printouts, and the developing device is replaced with a new one when it has run out of the toner. That is, there were no toner leaks prior to the toner in the developing device 50 being exhausted.

Although, in this embodiment, the TEFLON® felt fibers are aligned after the lubricating agent made by dispersing a fluorine oil and a fluorine-based resin in a fast-drying solvent is applied to the TEFLON® felt members 113, aligning the TEFLON® felt fibers without applying such a lubricating agent also allows the TEFLON® felt member to gain a higher toner sealing ability, compared to a conventional developing device.

As described above, by aligning the TEFLON® felt fibers with the rotation direction of the developing roller, the toner sealing ability of the TEFLON® felt members 113 can be improved.

In the above-described embodiment, the process cartridge 2*a* in which the developing device 50 is mounted is detachably attached to the laser beam printer 1. The invention, however, is not limited to such an exemplary case. The developing device 50 alone may be detachably attached to the image forming apparatus. Alternatively, the developing device 50 is not necessarily detachably attached to the laser beam printer 1, and may be stationarily mounted on the laser beam printer 1. When the invention is applied to a process cartridge, toner leaks are reliably prevented when it is detached/attached. Also, when the invention is applied to a stationary developing device, toner leaks due to vibration are prevented.

What is claimed is:

1. A developing device, comprising:

a container accommodating a developing agent;

a developing agent carrier that carries the developing agent supplied from the container; and developing agent leak prevention members, a developing agent leak prevention member disposed at either end of the developing agent carrier to make sliding contact with either end thereof and having a sliding contact surface to which a lubricating agent is applied, the lubricating agent made by dispersing a resin in a solvent.

2. The developing device according to claim 1, wherein the developing agent carrier is roller-shaped and has a circumferential surface that makes sliding contact, at either end, with the sliding contact surface of the developing agent leak prevention members.

3. The developing device according to claim 2, wherein the developing agent leak prevention members are made of a fluorine-based resin in fiber form.

4. The developing device according to claim 3, wherein fibers on the sliding surface are previously aligned with a rotation direction of the developing agent carrier.

5. The developing device according to claim 2, wherein the resin is a fluorine-based resin.

6. The developing device according to claim 5, wherein the lubricating agent further contains a fluorine oil.

7. The developing device according to claim 5, wherein the fluorine-based resin is polytetrafluoroethylene (PTFE).

8. The developing device according to claim 6, wherein the lubricating agent comprises 80–90 wt. % hydroflourocarbon and 10–20 wt. % polytetrafluoroethylene.

9. The developing device according to claim 2, further comprising a developing agent stopper disposed ahead of each of the developing agent leak prevention members and at a lower-end front edge of the container to stop the developing agent on a bottom surface of the container from leaking.

10. The developing device according to claim 9, wherein at least one developing agent stopper is formed by a film member affixed to the lower-end front edge of the container.

11. The developing device according to claim 9, wherein at least one developing agent stopper is formed by a resin member assembled to the container.

12. A process cartridge, comprising:

a container accommodating a developing agent;

a developing agent carrier that carries the developing agent supplied from the container; and developing agent leak prevention members, a developing agent leak prevention member disposed at either end of the developing agent carrier to make sliding contact with either end thereof and having a sliding contact surface to which a lubricating agent is applied, the lubricating agent made by dispersing a resin in a solvent; and a photosensitive body having an electrostatic latent image formed thereon and disposed opposite the developing agent carrier, wherein the developing agent carrier is roller-shaped and has a circumferential surface that makes sliding contact, at either end, with the sliding contact surface of the developing agent leak prevention members.

13. The process cartridge according to claim 12, further comprising:

a charger that uniformly charges the photosensitive body;

a supply member that supplies the developing agent in the container to the developing agent carrier;

a layer thickness-regulating member that forms the developing agent on the developing agent carrier into a thin layer; and a transfer member that transfers a visible image formed on the photosensitive body to a sheet.

14. An image forming apparatus, comprising:

a container accommodating a developing agent;

a developing agent carrier that carries the developing agent supplied from the container; and developing agent leak prevention members, a developing agent leak prevention member disposed at either end of the developing agent carrier to make sliding contact with either end thereof and having a sliding contact surface to which a lubricating agent is applied, the lubricating agent made by dispersing a resin in a solvent;

a photosensitive body having an electrostatic latent image formed thereon and disposed opposite the developing agent carrier, wherein the developing agent carrier is roller-shaped and has a circumferential surface that makes sliding contact, at either end, with the sliding contact surface of the developing agent leak prevention members;

a sheet conveying device that supplies a sheet to the transfer member; and a fixing device that fixes the developing agent to the sheet to which the visible image is transferred.

15. The developing device according to claim 5, wherein the solvent is a volatile solvent.

* * * * *